US007201030B2

(12) United States Patent
Timothy

(10) Patent No.: US 7,201,030 B2
(45) Date of Patent: Apr. 10, 2007

(54) GATE LOCK DEVICE

(76) Inventor: E. Erik Timothy, 6704 Brighton Park Dr., Apollo Beach, FL (US) 33572

( * ) Notice: Subject to any disclaimer, the term of this patent is extended or adjusted under 35 U.S.C. 154(b) by 32 days.

(21) Appl. No.: 10/989,602

(22) Filed: Nov. 17, 2004

(65) Prior Publication Data

US 2006/0101876 A1 May 18, 2006

(51) Int. Cl.
*E05B 65/06* (2006.01)

(52) U.S. Cl. ..... 70/101; 70/135; 70/190; 292/127

(58) Field of Classification Search ..... 292/135–137, 292/127, 230, 207, 108, 210; 70/101, 135, 70/137, 139, 154, 155, 190
See application file for complete search history.

(56) References Cited

U.S. PATENT DOCUMENTS

| | | | | |
|---|---|---|---|---|
| 204,267 | A | 5/1878 | Unger | |
| 394,685 | A | 12/1888 | Fether | |
| 409,438 | A | 8/1889 | Whitehouse | |
| 411,955 | A | 10/1889 | Ellis | |
| 695,736 | A | 3/1902 | Kendrick | |
| 767,567 | A | 8/1904 | Keil | |
| 824,027 | A | 6/1906 | Keeler | |
| 876,300 | A | 1/1908 | Couret | |
| 1,661,548 | A | 3/1928 | Stuart et al. | |
| 1,662,255 | A | 3/1928 | Stuart et al. | |
| 1,664,576 | A | 4/1928 | Stuart et al. | |
| 1,700,299 | A | 1/1929 | Wolters | |
| 1,805,789 | A | 5/1931 | Stuart et al. | |
| 1,954,500 | A | 4/1934 | Parks | |
| 2,115,947 | A | 5/1938 | Ellison | |
| 2,161,519 | A | 6/1939 | Loftin et al. | |
| 2,526,979 | A | 10/1950 | Tomlinson | |
| 2,767,006 | A | 10/1956 | Patrick | |
| 3,433,518 | A | 3/1969 | Foltz | |
| 3,596,954 | A | 8/1971 | Hull | |
| 3,690,132 | A | 9/1972 | Engstrom | |
| 4,195,866 | A | 4/1980 | Tundo et al. | |
| 4,305,611 | A | 12/1981 | Robins | |
| 4,451,072 | A | 5/1984 | Petty, Sr. | |
| 5,116,090 | A | 5/1992 | Nichandros | |
| 5,129,691 | A | 7/1992 | McFarlen | |
| 5,358,292 | A | 10/1994 | Van Wiebe et al. | |
| 5,498,041 | A | 3/1996 | Bezzerides et al. | |
| 5,655,801 | A | 8/1997 | Casey | |
| 5,868,446 | A | 2/1999 | Rossmo | |
| 6,058,747 | A * | 5/2000 | Doyle et al. | 70/137 |
| 6,170,892 | B1 | 1/2001 | Lantiegne | |
| 6,347,819 | B1 * | 2/2002 | Plaxco | 292/336 |
| 6,513,351 | B2 * | 2/2003 | Clark | 70/101 |
| 6,898,953 | B1 * | 5/2005 | Paprocki et al. | 70/106 |
| 2001/0009105 | A1 | 7/2001 | Clark | |
| 2002/0060460 | A1 | 5/2002 | DeSouza | |
| 2003/0230901 | A1 | 12/2003 | Krynski | |

* cited by examiner

*Primary Examiner*—Suzanne Dino Barrett
(74) *Attorney, Agent, or Firm*—George R. McGuire; Bond, Schoeneck & King PLLC

(57) ABSTRACT

A gate lock device with front and rear units to be mounted on opposite sides of a structure associated with the gate and against which the gate closes. A gravity latch, displaceably mounted in the housing of the front unit, is engageable with a keeper pin. The front and rear units are provided with key-operated locks which are operable to lock and unlock the gravity latch. The rear unit includes an axially displaceable actuator operable to unlock the gravity latch when the key-operated locks are unlocked.

14 Claims, 7 Drawing Sheets

GATE LOCK DEVICE

FIELD OF THE INVENTION

The present invention relates to gate locks for securing a gate, door or the like structure in a closed position. More particularly, the invention concerns a latch device having front and rear units adapted to be mounted on opposite sides of a structure associated with the gate and against which the gate closes, the device including a manually displaceable gravity latch displaceably mounted in a first housing in the front unit and a keeper pin engageable with the gravity latch.

BACKGROUND OF THE INVENTION

Prior art gate latches are exemplified by U.S. Pat. No. 6,058,747 to Doyle et al. and U.S. Pat. No. 6,513,351 to Clark. The Doyle et al. patent discloses a gravity latch which includes a housing for pivotally mounting a closure member and a cylinder lock located below the closure member. Doyle et al. disclose a remote actuator mounted on the opposite side of the fence, etc., from where the housing is located for moving the closure member. Also, the remote actuator may include a cylinder lock to hold it in a locked position so that the actuator cannot be operated.

The Clark patent also discloses a gravity latch which includes a housing for pivotally mounting a closure member and a cylinder lock situated below the closure member. Clark also discloses a remote actuator mounted oh the opposite side of the fence, etc., from where the housing is located. Also, the remote actuator may include a cylinder lock which is connected through a gearing system to allow for locking the closure member from the remote location.

Both the Doyle et al. and Clark patents disclose the use of a front housing defining an upward facing slot through which extends a tab for mounting a knob for manual operation of the closure member.

However, in comparison to the prior art discussed above, the gate lock device of the present invention has the advantages of simplicity, increased robustness, reduced costs, among other advances in the art. An advantage of the present invention in comparison to the devices illustrated in the prior art above, is found in the simplicity of the design. This simplicity allows for an increased robustness of the device and a less costly manufacturing process. Thus, the device of the present invention performs the locking functions similar to the Clark patent but does so with a reduced number of components as compared to the multiple gear system disclosed in the Clark patent. Furthermore, the device of the present invention has an improved design in the latch knob area wherein the front housing has a downwardly sloping slot through which the manual retraction element for the gravity latch extends and is provided with a manually graspable handle. This arrangement helps to keep debris from the environment (e.g., leaves, trash) from entering the slot and hindering the gravity latch operation.

In addition, the device of the present invention uses the same mounting plates on both the front and rear units, respectively, both of which are removable to allow for adjustment during assembly to permit the gate lock device to be mounted in a left or right hand orientation. An additional advantage over the prior art is that, by separating the key-actuated lock on the rear housing unit from the manually operable push button for the linear actuator on the rear housing unit, the overall rear housing unit does not protrude as far as the prior art and permits different styling options to be used.

SUMMARY OF THE INVENTION

According to the present invention, I provide a latch device for use with a gate, door or the like structure, the latch device having front and rear units adapted to mounted on opposite sides of a structure associated with the gate, etc., and against which the gate closes. The latch device includes a front unit having a first housing adapted to be mounted on the structure, a manually displaceable gravity latch displaceably mounted in the housing and adapted to interengage with a keeper pin mounted on the gate and for holding the keeper pin in a closed position to prevent opening of the gate, a locking means displaceably mounted in the housing for locking the latch when in a locking position and displaceable to a retracted position in which the latch is released, and a key activated front lock, mounted on the upper portion of the first housing. Further, in accordance with the present invention, the rear unit has a second housing accommodating a key-actuated rear lock, mounted on the upper portion of the second housing, a rotatable actuator, and an axially displaceable actuator mounted on the lower portion of the second housing.

The latch device according to the present invention is operable upon actuation of either the front lock or the rear lock to displace the locking means between its locking and retracted positions and is operable, when the front lock and the rear lock is in an unlocked position, to permit the axially displaceable actuator of the rear unit to displace the gravity latch to release the keeper pin. The device includes a rotatably displaceable mechanism for displacing the locking means and a lost motion system which permits the displacement of the locking means to be achieved by operation of either the front lock or the rear lock. Further, the axially displaceable actuator has axially displaceable means for engaging and displacing the gravity latch to release the keeper pin when either of the locks are unlocked and the axially displaceable actuator is displaced in the second housing toward the front unit of the device.

According to another aspect of the latch device of the present invention, the locking means comprises a rotatable cam and a cam follower, the cam being connected to the key-actuated front lock and the rotatable actuator. In addition, the cam follower has a portion that is engagable with the gravity latch to fix the latch in a position.

According to still a further aspect of the present invention, we provide a retraction element connected to the gravity latch for permitting the gravity latch to be manually moved to its retracted position to release the keeper pin. The retraction element extends downwardly from the gravity latch through a downwardly positioned opening in the front housing whereby environmental debris does not easily enter the opening to jam the retraction element. Additional features of the invention will be described below with reference to the accompanying drawings.

DETAILED DESCRIPTION OF THE DRAWINGS

Figure 1:
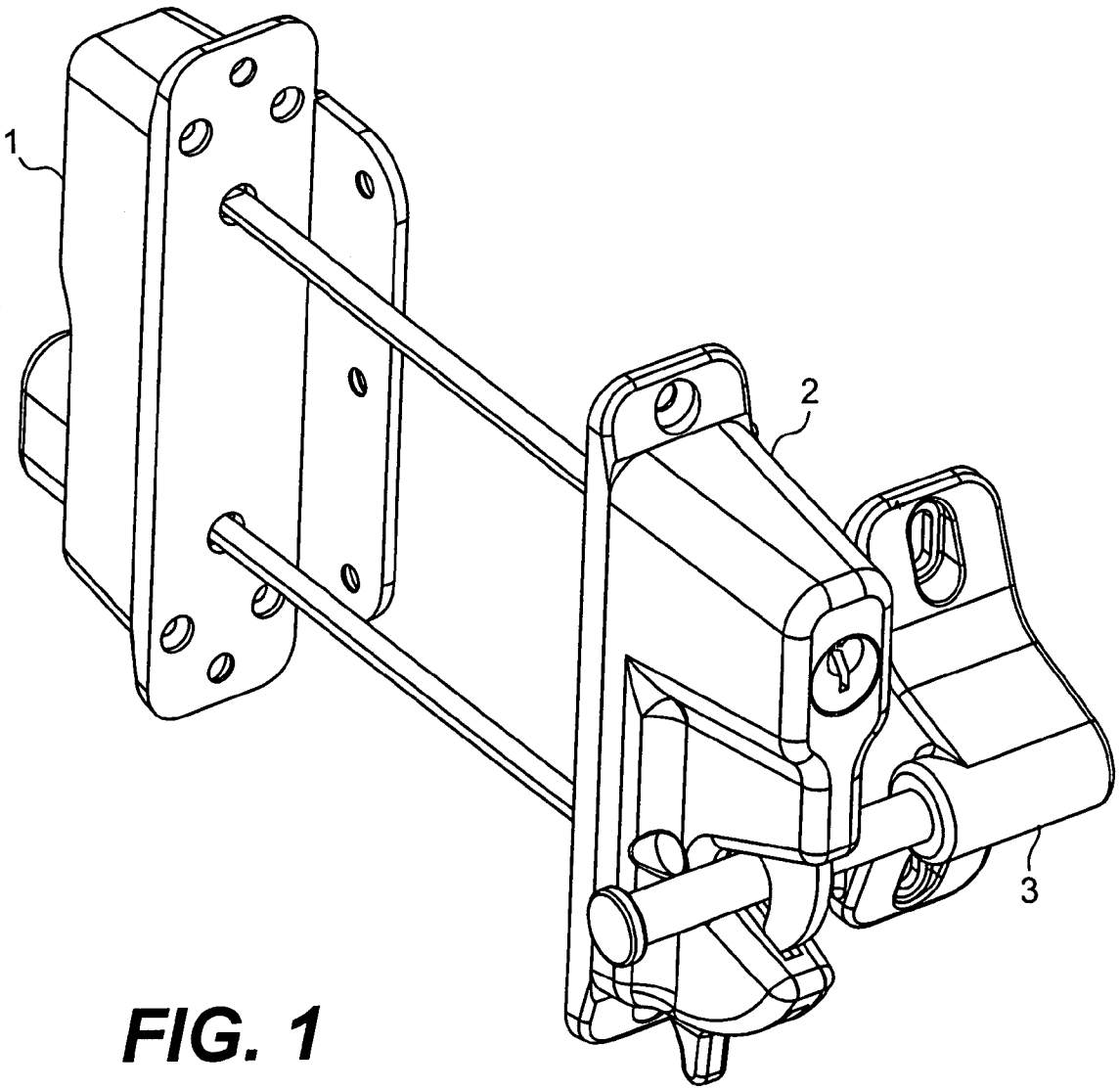
FIG. 1 is an overall view of one embodiment of a gate latch device of the present invention.

Referring to the drawings, a latch device in accordance with an embodiment of the present invention is illustrated with the same reference numerals used throughout the figures for the same components.

Figure 2:
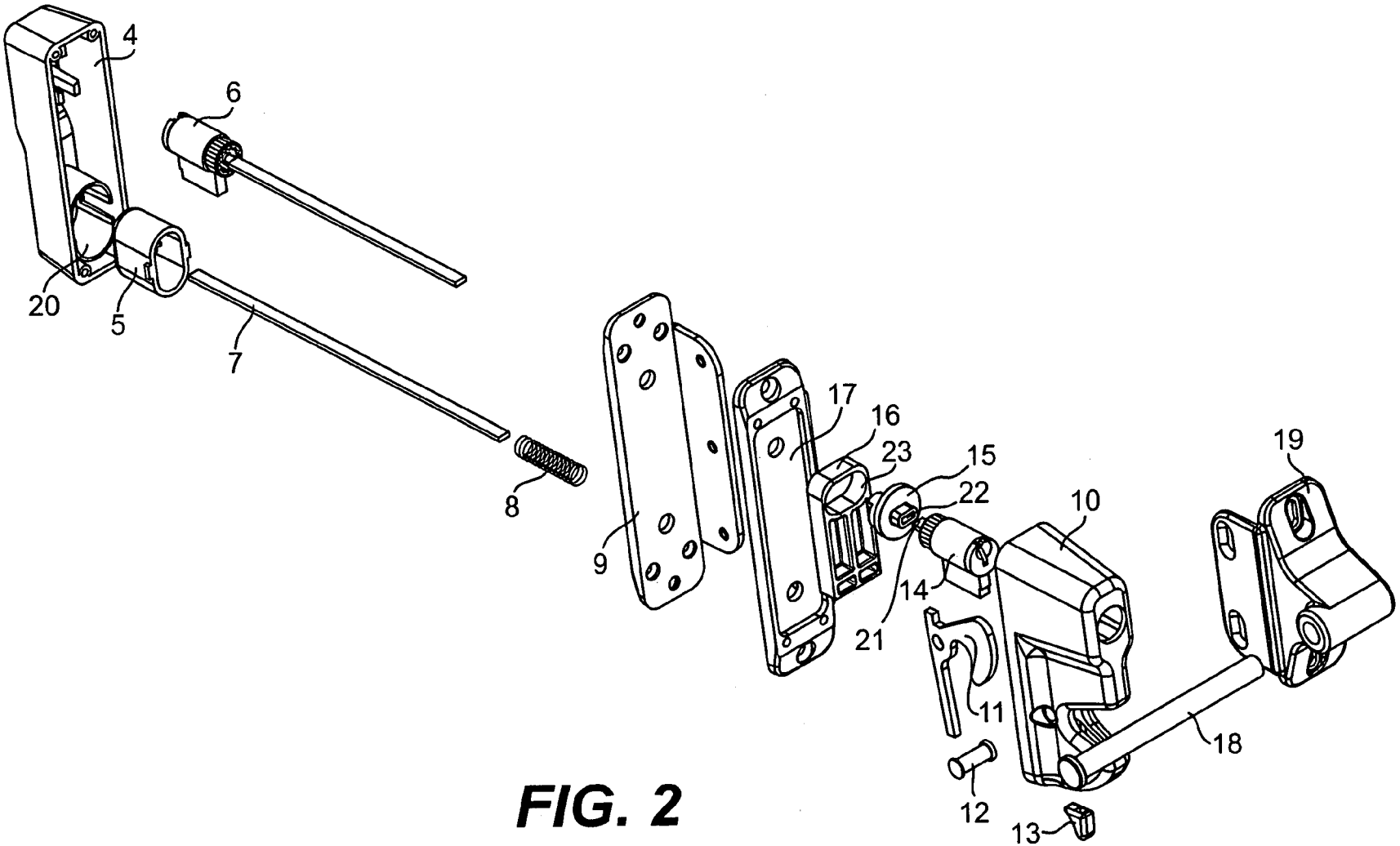
FIG. 2 is an exploded view of the device shown in FIG. 1.
Figure 3:
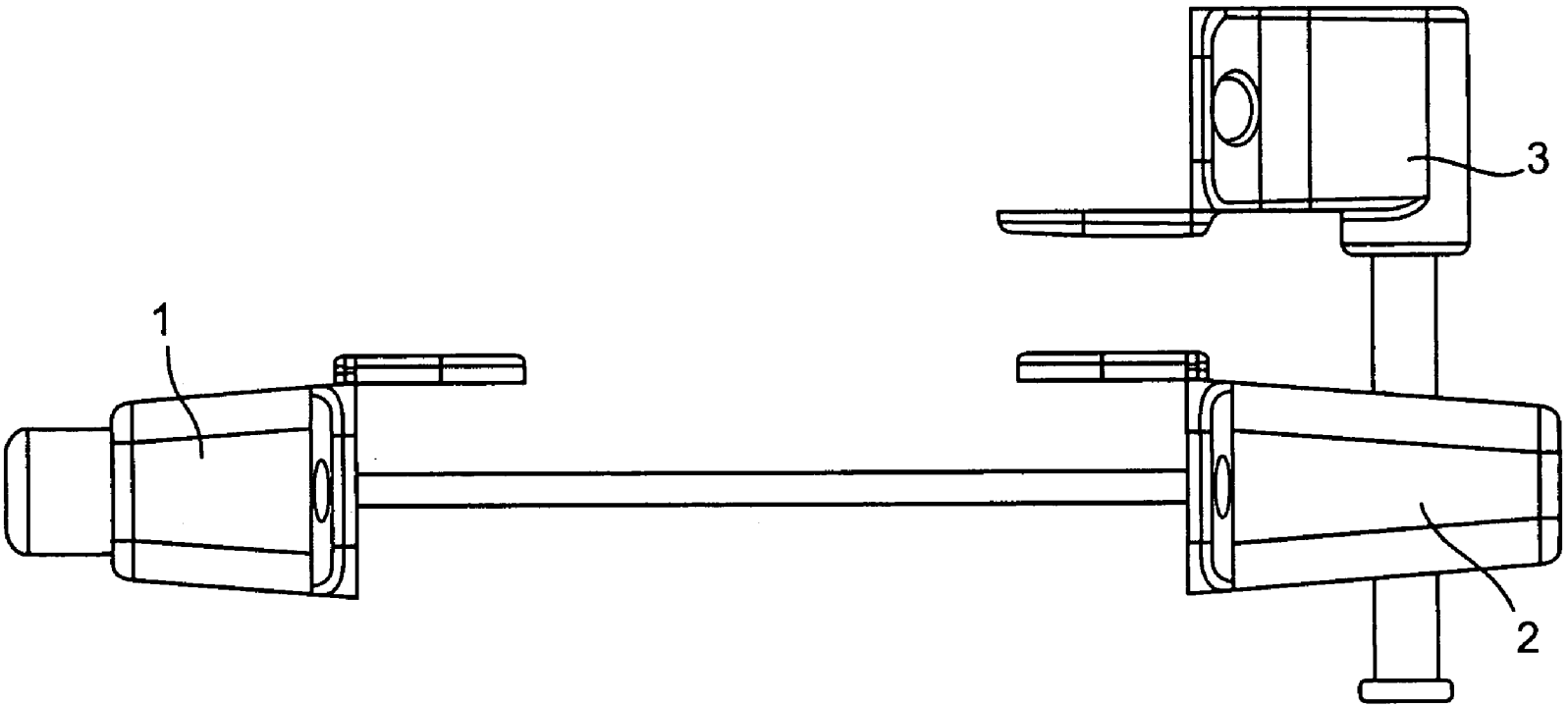
FIG. 3 is a plan view of the device shown in FIG. 1.

FIG. 1 shows an overview of the latch device comprising rear unit (1), front unit (2) and a keeper assembly (3). FIG. 2 shows an exploded view of the assembly of FIG. 1. FIG. 3 is a plan view of the assembly of FIG. 1. The rear unit (1) is made up of the button housing (4) with a button opening (20) which holds and supports the button (5) allowing it to move axially toward and away from the front unit. The button (5) has a button spindle (7) rigidly mounted to it. A coil spring (8) is mounted over the button spindle (7) and rides between the button housing mounting plate (9) and the button (5), biasing the button (5) into the outward position away from the front unit. A rear lock cylinder (6) is also mounted in the upper end of the button housing (4) and is held in by the button housing mounting plate (9). The front unit (2) is made up of the latch housing (10) and the latch housing mounting plate (17). The gravity latch (11) is mounted in the latch housing (10) with rivet (12) allowing it to freely pivot within the latch housing (10). The latch knob (13) is mounted to the retraction element formed by the lower portion of the gravity latch (11) creating a place to manually operate the gravity latch (11). Latch lock cylinder (14) is mounted in the latch housing (10). The latch lock cylinder spindle (21) fits into the cam (15) through the cam spindle opening (22) allowing the latch lock cylinder (14) to rotate the cam (15). The cam (15) fits into the cam opening (23) of the cam follower (16). Rotation of the cam (15) moves the cam follower (16) up and down. The keeper assembly (3) is made up of the keeper housing (19) and the keeper pin (18).

As used herein, the following elements comprise the displaceable locking means for locking the gravity latch: spindle (21), cam (15), and cam follower (16) defining a cam opening (23).

Figure 4:
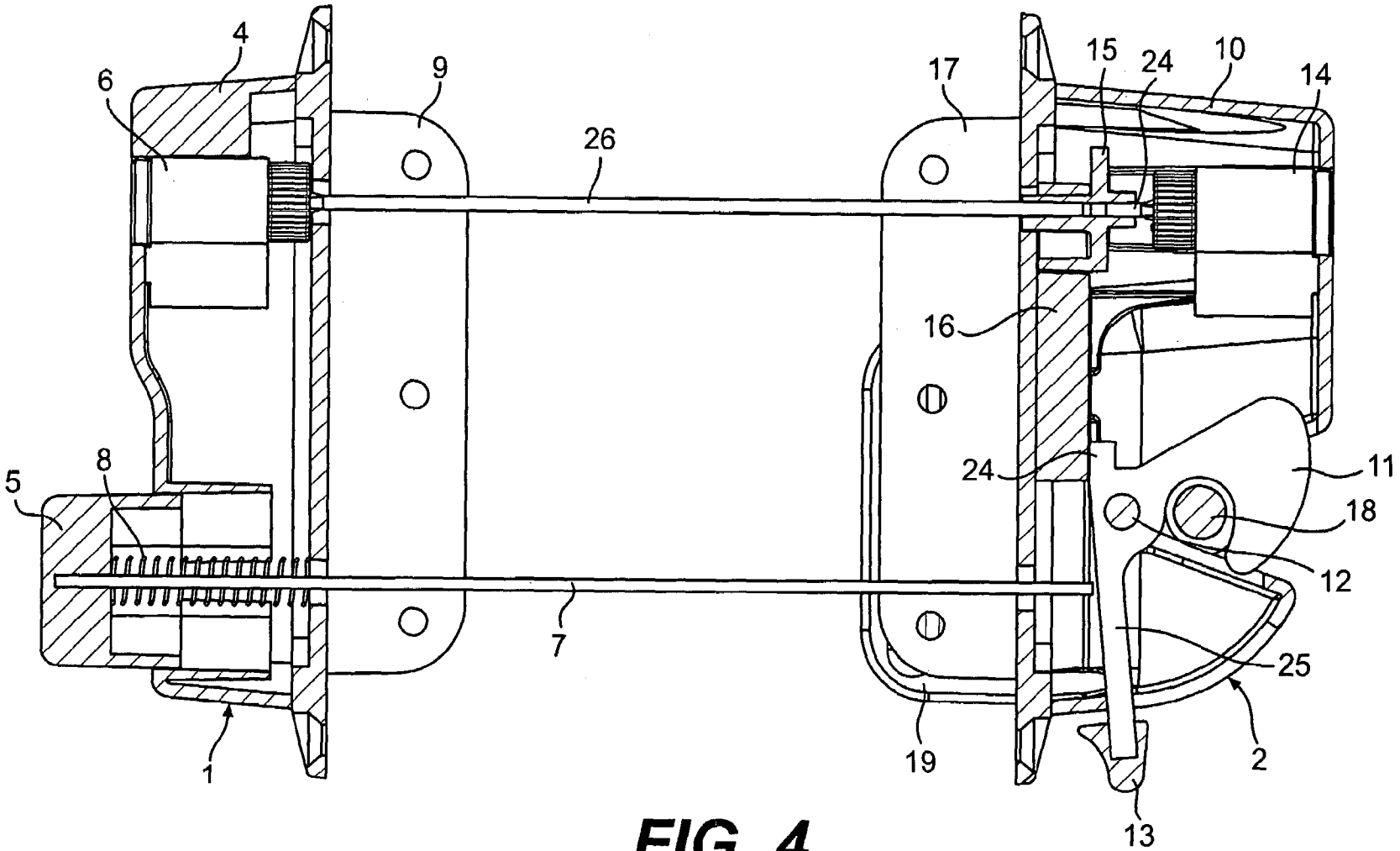
FIG. 4 is a cutaway view of the device shown in FIG. 1 when in a locked position.

FIG. 4 shows a cut away of the entire assembly in the locked position. When the assembly is mounted, the rear lock cylinder spindle (26) mounts into the cam spindle opening (22). Both front and rear lock cylinders have about 180 degrees of lost motion which allows either lock cylinder to turn the cam (15) while the other can freely rotate without creating interference. The rotation of the cam (15) moves the cam follower (16) up and down. FIG. 4 shows the cam follower (16) in the downward position where the cam follower (16) is in back of the locking portion (24) of the gravity latch (11), blocking it from rotating in a counter-clockwise direction.

Figure 5:
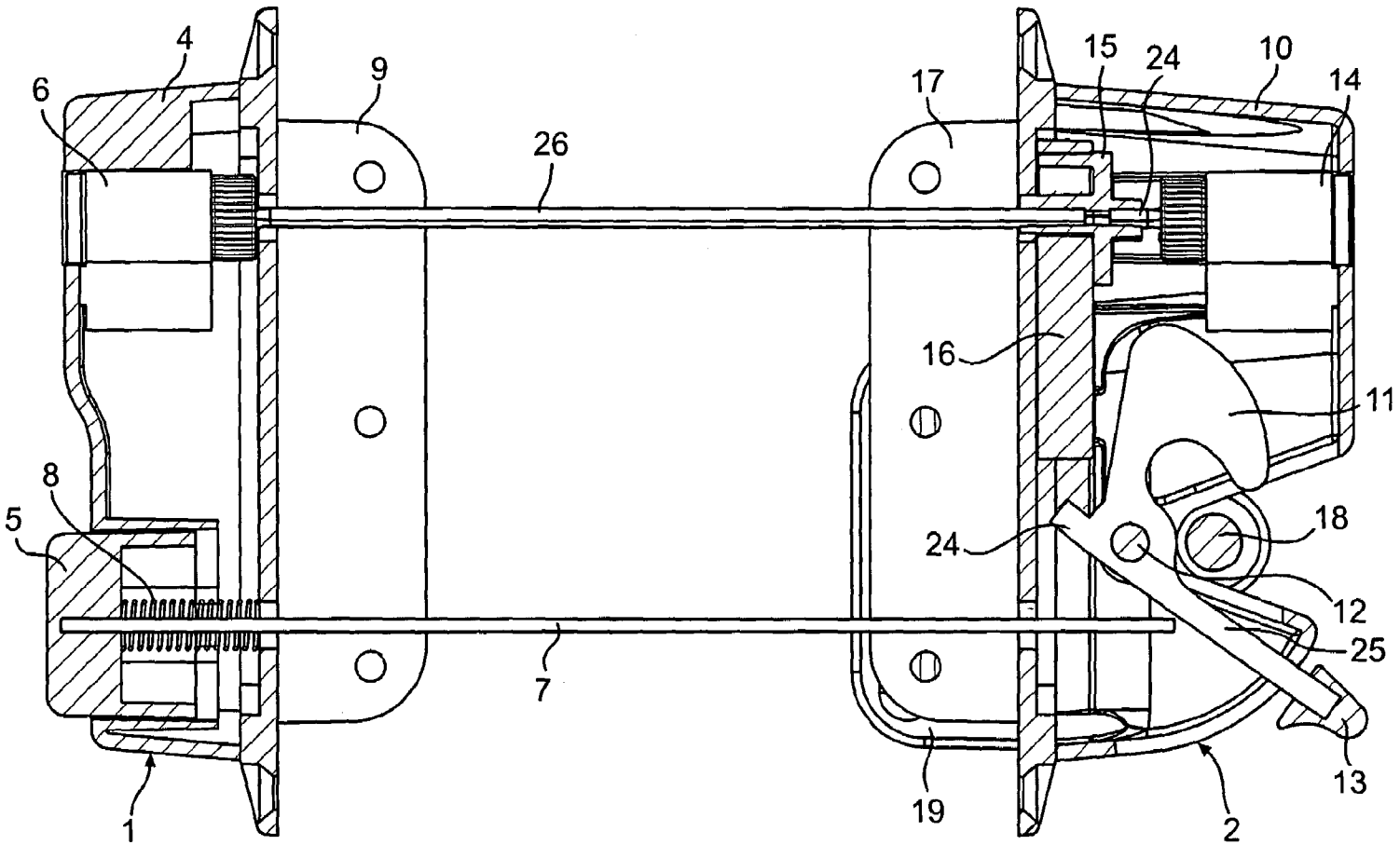
FIG. 5 is a cutaway view of the device shown in FIG. 1 when in an unlocked position.

FIG. 5 shows a cut away of the entire assembly in the unlocked position with the button (5) depressed and the gravity latch (11) rotated to the unlatched position. With the cam follower (16) in the upward position, the assembly is unlocked and the gravity latch (11) is free to turn about the rivet (12) to release the keeper pin (18). When the button (5) is depressed into housing (4), it moves the button spindle (7) axially so that it makes contact with the retraction element formed by the lower portion (25) of the gravity latch (11), rotating it into the unlatched position.

Figure 6:
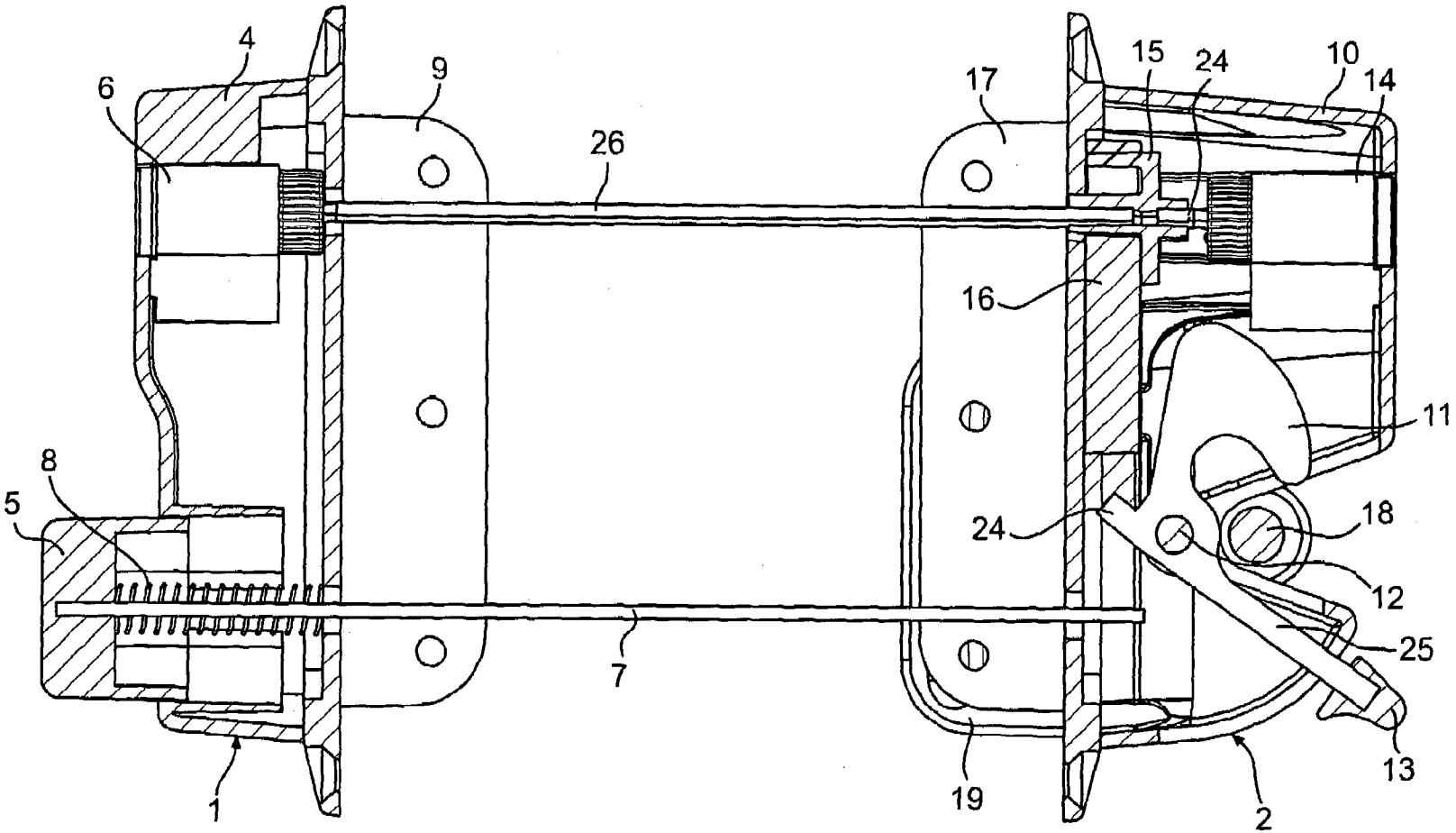
FIGS. 6 and 7 are additional cutaway views of the device shown in FIG. 1 when in an unlocked position with the gravity latch in an open position (FIG. 6) and a closed and unlocked position (FIG. 7).

FIG. 6 shows a cut away of the entire assembly in the unlocked position with the gravity latch (11) rotated to the unlatched position. With the cam follower (16) in the upward position, the assembly is unlocked and the gravity latch (11) is free to turn about the rivet (12) to release the keeper pin (18). This figure shows the latch knob (13) used to manually rotate the gravity latch (11) into the unlatched position. The latch knot (13) allows for manual force to be used to move the gravity latch in the upward direction without causing twisting of the latch (11) on its rivet (12) which defines the pivot axis for the latch (11).

Figure 7:
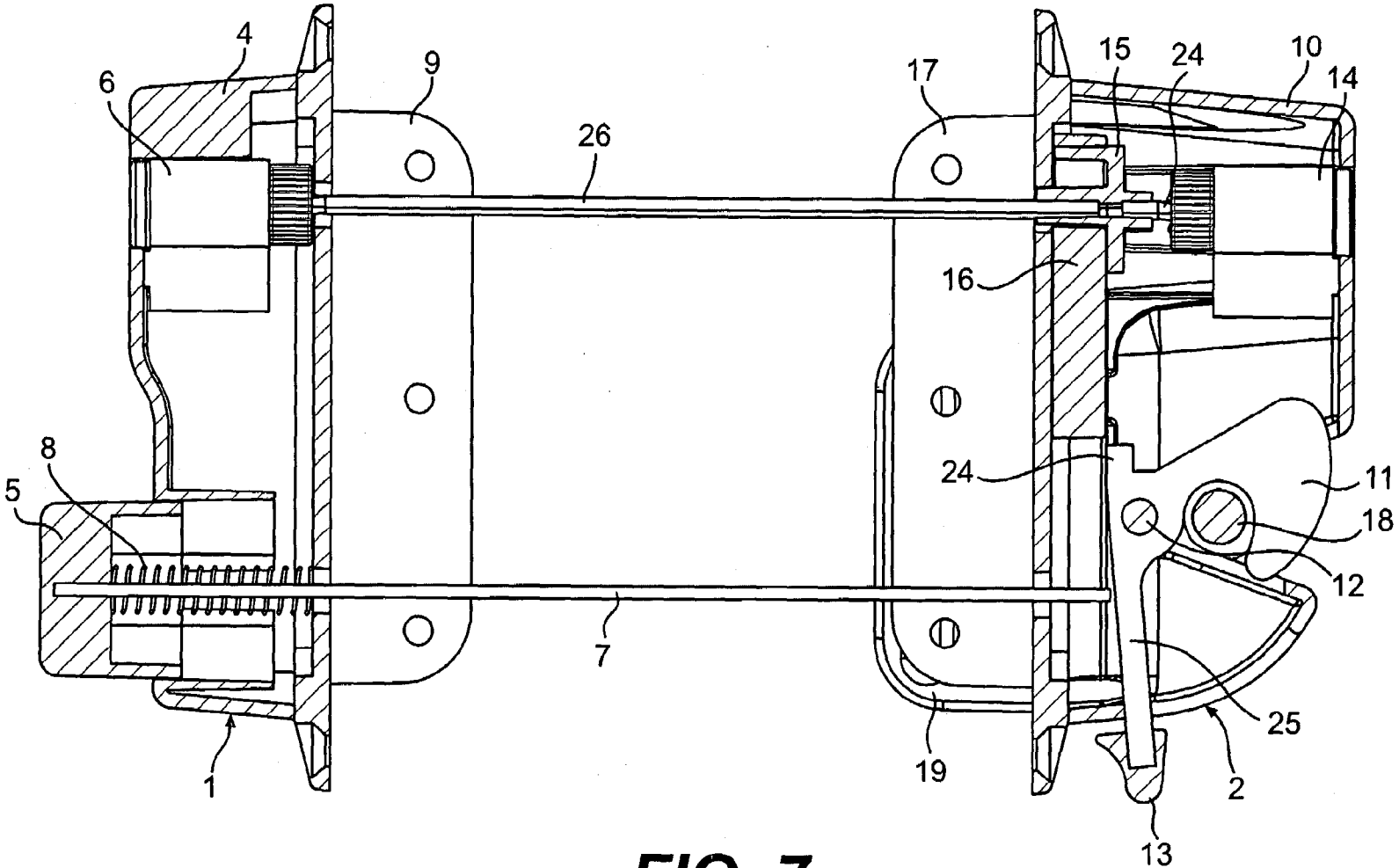

FIG. 7 shows a cut away of the entire assembly in the unlocked position. In this figure, the cam follower (16) is in the upward position so the assembly is in the unlocked position. The button (5) and gravity latch (11) are shown in their at rest positions.

What is claimed is:

1. A device for latching a gate, comprising:
- a first housing comprising:
  - a gravity latch mounted therein;
  - a locking mechanism interconnected to said gravity latch; and
  - a first lock positioned above said gravity latch;
- a second housing comprising:
  - a second lock, wherein said first lock and said second lock are aligned along a common axis;
  - an actuator interconnected to said second lock; and
  - a button positioned below said second lock and interconnected to said gravity latch.

2. The device of claim 1, wherein said locking mechanism comprises:
- a cam interconnected to said first lock and said actuator;
- a cam follower interconnected to said cam, whereby rotation of said cam causes movement of said cam follower into and out of engagement with said gravity latch.

3. The device of claim 1, further comprising a retraction element connected to said gravity latch for permitting said gravity latch to be manually moved.

4. The device of claim 3, wherein said retraction element extends downwardly through a slot defined in said first housing.

5. The device of claim 1, wherein said cam fits into said cam follower.

6. The device of claim 5, wherein rotation of said cam results in axial movement of said cam follower.

7. The device of claim 1, wherein said first and second locks are capable of about 180 degrees of lost motion.

8. A device for latching a gate, comprising:
- a first housing comprising:
  - a gravity latch mounted therein;
  - a locking mechanism interconnected to said gravity latch; and
  - a first lock positioned in said first housing;
- a second housing comprising:
  - a second lock, wherein said first lock and said second lock are aligned along a common axis;
  - an actuator interconnected to said second lock; and
  - a button positioned below said second lock and interconnected to said gravity latch;
- wherein said locking mechanism comprises:
  - a cam interconnected to said first lock and said actuator;
  - a cam follower interconnected to said cam, whereby rotation of said cam causes movement of said cam follower into and out of engagement with said gravity latch.

9. The device of claim 8, wherein said cam follower includes a portion engageable with said gravity latch.

10. The device of claim 8, further comprising a retraction element connected to said gravity latch for permitting said gravity latch to be manually moved.

11. The device of claim 10, wherein said retraction element extends downwardly through a slot defined in said first housing.

12. The device of claim 8, wherein said cam fits into said cam follower.

13. The device of claim 12, wherein rotation of said cam results in axial movement of said cam follower.

14. The device of claim 8, wherein said first and second locks are capable of about 180 degrees of lost motion.

* * * * *